US005155394A

United States Patent [19]

Szepesi

[11] Patent Number: 5,155,394

[45] Date of Patent: Oct. 13, 1992

[54] BIAS DISTRIBUTION CIRCUIT AND METHOD USING FET AND BIPOLAR

[75] Inventor: Tamas S. Szepesi, San Jose, Calif.

[73] Assignee: National Semiconductor Corporation, Santa Clara, Calif.

[21] Appl. No.: 667,864

[22] Filed: Feb. 12, 1991

[51] Int. Cl.[5] ..... G06G 7/10

[52] U.S. Cl. ..... 307/491; 307/310; 307/570; 307/296.6

[58] Field of Search ..... 307/491, 310, 570, 246.4, 307/296.5, 296.6, 296.8; 323/907, 312-317; 330/257, 288

[56] References Cited

U.S. PATENT DOCUMENTS

| | | | |
|---|---|---|---|
| 4,438,349 | 3/1984 | Shoji | 330/257 |
| 4,461,991 | 7/1984 | Smith | 307/296.8 |
| 4,492,929 | 1/1985 | Vyne | 330/257 |
| 4,532,467 | 7/1985 | Mensink | 307/496 |
| 4,608,530 | 8/1986 | Bacrania | 307/296.8 |
| 4,656,374 | 4/1987 | Rapp | 307/570 |
| 4,658,137 | 4/1987 | McGowan | 307/491 |
| 4,659,944 | 4/1987 | Miller | 307/296.5 |

FOREIGN PATENT DOCUMENTS

| | | | |
|---|---|---|---|
| 9014712 | 11/1990 | World Int. Prop. O. | 307/491 |

*Primary Examiner*—Eugene R. Laroche
*Assistant Examiner*—A. Zarabian
*Attorney, Agent, or Firm*—Limbach & Limbach

[57] ABSTRACT

A biasing circuit and method of producing a biasing voltage particularly suitable for integrated circuits combining MOS and bipolar technology. The circuit includes an NMOS transistor which produces a gate-source reference voltage when drain current is supplied to the transistor. The reference gate-source voltage is coupled to the output of the circuit at a reduced impedance level so as to increase noise immunity. The coupling circuit preferably includes two NPN bipolar transistors. The NPN transistors add and subtract identical base-emitter junction voltages to the reference voltage so that the magnitude of the reference voltage is unchanged. An NMOS transistor, having a gate-source voltage equal to the reference voltage, is also connected to the output for reducing the output impedance of the circuit.

13 Claims, 1 Drawing Sheet

BIAS DISTRIBUTION CIRCUIT AND METHOD USING FET AND BIPOLAR

BACKGROUND OF THE INVENTION

1. Field of the Invention

The present invention relates generally to biasing circuits and methods and, more particularly, to biasing circuits for use in integrated circuits which contain both bipolar and field effect transistors.

2. Background Art

Biasing circuits are used in integrated circuits for determining internal voltage and current levels at various points in the integrated circuit. Exemplary biasing circuits are disclosed in *Bipolar and MOS Analog Circuit Desion*, Alan B. Grebene, 1984, pages 169–212 and 276–277. Typically, it is desirable that the voltage and current levels remain constant despite variations in temperature, processing and power supply voltages.

FIG. 1A shows a conventional integrated biasing circuit utilizing bipolar transistors. A reference NPN transistor 10 is provided which has its base and collector electrodes connected in common to the output of a current source 12. The emitter electrode of transistor 10 is connected to the circuit common (or the integrated circuit negative supply.)

Current source 12 provides a collector current $I_B$ to transistor 10 which results in a certain base-emitter voltage $V_c$ at node 14. Voltage $V_c$ is a biasing voltage that can be used to bias other exemplary integrated circuit elements, including transistors 16 and 18. Transistors 16 and 18 have their base electrodes connected in common with the base electrode of reference transistor 10 and their emitter electrodes connected in common with the emitter electrode of transistor 10.

Assuming that the base-emitter junction areas of transistors 10, 16 and 18 are the same, the collector currents $I_B$, $I_{C1}$ and $I_{C2}$ will be approximately equal. This approximation ignores the effects of base current and the differences in collector voltages of the three transistors.

The FIG. 1A circuit is commonly referred to as a current mirror, since the collector current $I_B$ in transistor 10 is "mirrored" in the collectors of transistor, 16 and 18.

The base-emitter voltages of transistors 10, 16 and 18 are equal so that the current densities of the three transistors will also be maintained approximately equal. The currents in transistors 16 and 18 can be adjusted by varying the emitter-base junction areas of the transistors, as is well known. If, for example, the emitter-base junction area of transistor 16 were twice that of transistor 10, the collector current of transistor 16 would be approximately one-half that of transistor 10.

FIG. 1B is a diagram of a further exemplary conventional biasing circuit which utilizes N channel metal oxide semiconductor (NMOS) transistors rather than the bipolar NPN transistors of the circuit of FIG. 1A. The FIG. 2B biasing circuit includes a reference NMOS transistor 20 having a source electrode connected to the circuit common. The gate electrode of transistor 20 is connected to the drain electrode and to a current source 12.

Current source 12 provides a current $I_B$ to transistor 20 which causes the transistor to produce a certain gate-source voltage $V_C$ at node 22. Voltage $V_C$ is a biasing voltage which can then be used to bias the gate-sources electrodes of transistors, such as transistors 24 and 26.

Assuming that transistors 24 and 26 have the same geometry (W and L) as reference transistor 20, the current conducted by those transistors, $I_{C1}$ and $I_{C2}$, respectively, will be equal to current $I_B$.

The biasing circuits of FIGS. 1A and 1B posses at least two serious shortcomings. First, voltage $V_C$ varies with temperature, which can be undesirable in many applications. Second, the node which carries the biasing voltage is a relatively high impedance node. As a result, the biasing circuit is susceptible to the introduction of noise.

The present invention is directed to a biasing circuit and method which produces a bias voltage which is relatively stable with temperature. The circuit output is at a low impedance, therefore, the circuit is less susceptible to noise than convention biasing circuits. These and other advantages of the present invention will become apparent to those skilled in the art upon a reading of the following Description of the Preferred Embodiment.

SUMMARY OF THE INVENTION

A biasing circuit and method of producing a biasing voltage are disclosed. The circuit includes a first field effect transistor, which is preferably an N channel MOS transistor (NMOS). Current source means is provided for supplying current to the field effect transistor so as to produce a gate-source reference voltage at a first node of the circuit.

The biasing circuit further includes means for coupling the gate-source reference voltage to an output of the biasing circuit at a reduced impedance level compared to the first node impedance level. The coupling means preferably includes a second field effect transistor and two bipolar transistors. The two bipolar transistors provide base-emitter junction voltages, which are preferably equal. The two bipolar transistors are configured to first add and then subtract their respective base-emitter junction voltages from the reference voltage so that the output bias voltage is equal to the reference voltage. The second field effect transistor is preferably connected to control the current flow through the bipolar transistor located at the bias circuit output and to reduce the impedance of the bias circuit output thereby increasing noise immunity. The current flow through the first field effect transistor is preferably selected so that the temperature coefficient of the bias voltage is approximately zero.

DESCRIPTION OF THE PREFERRED EMBODIMENT

Figure 1A:
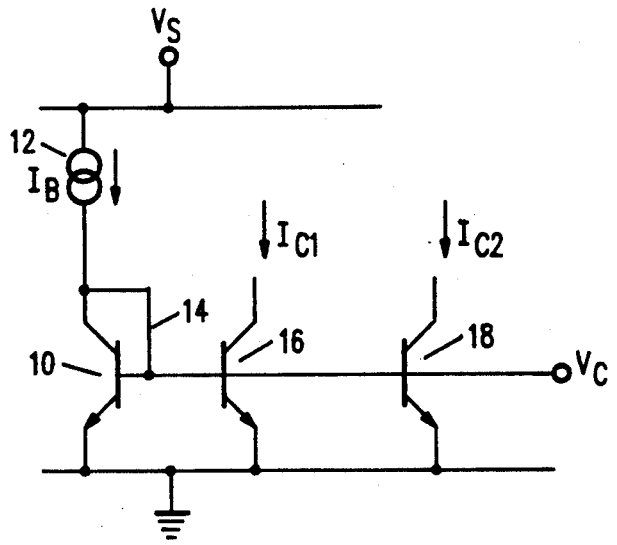
PRIOR ART FIG. 1A
FIGS. 1A and 1B are schematic diagrams of prior art integrated circuit biasing circuits.
Figure 1B:
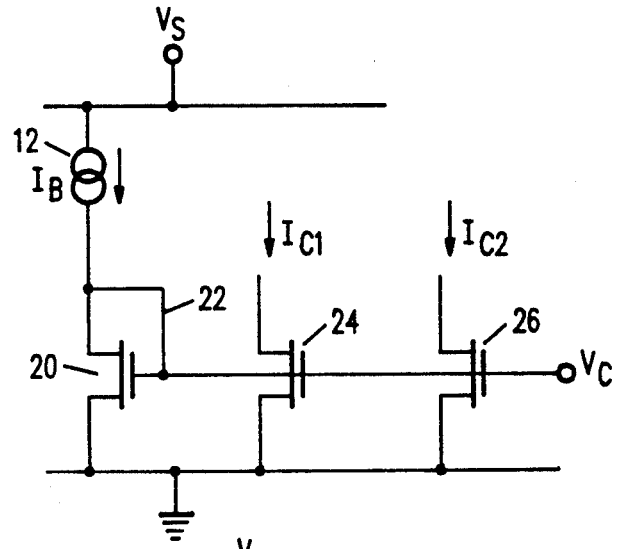
PRIOR ART FIG. 1B
Figure 2:
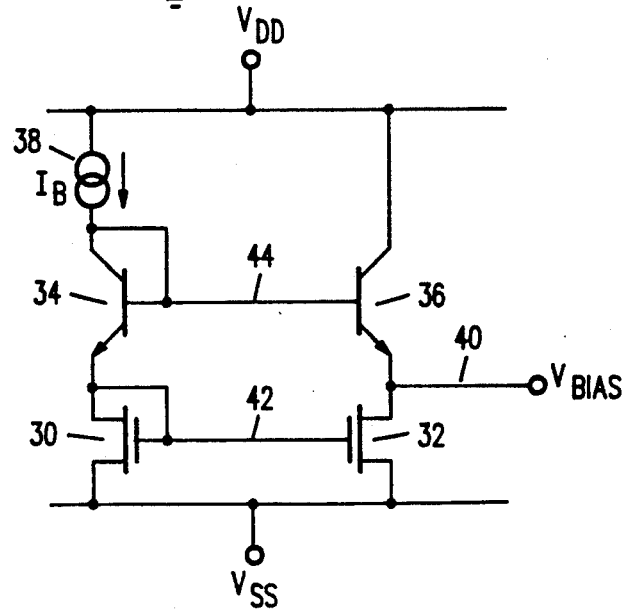
FIG. 2 is a schematic diagram of the bias circuit of the present invention.

Referring again to the drawings, the biasing circuit of FIG. 2 is comprised of both bipolar and field effect transistors and, therefore, has particular application to monlithic integrated circuits which combine bipolar and MOS transistors.

The FIG. 2 circuit includes a pair of NMOS transistors 30 and 32 and a pair of bipolar NPN transistor 34 and 36. The source electrodes of NMOS transistors 30 and 32 are connected to the most negative supply voltage $V_{SS}$ (or circuit common). The gate and drain electrodes of transistor 30 are connected together and to the emitter electrode of transistor 34. The base and collector electrodes of transistor 34 are, in turn, connected together and to one terminal of a current source 38. The remaining current source terminal is connected to the most positive supply voltage $V_{DD}$.

The gate electrode of NMOS transistor 32 is connected to the gate and drain electrodes of transistor 30. The drain electrode of transistor 32 is connected to the emitter electrode of transistor 36, with this junction forming the output 40 of the biasing circuit. The base electrode of transistor 36 is connected to the base and collector electrode of transistor 34 and the collector electrode of transistor 36 is connected to the positive supply voltage $V_{DD}$.

The operation of the biasing circuit of the present invention will now be described. Assuming that the base currents of the bipolar transistors are relatively small, transistor NMOS 30 will conduct a current (drain to source) equal to the current $I_B$ provided by current source 38. This will cause NMOS transistor 30 to produce a predetermined gate-source voltage at node 42. This voltage is sometimes referred to as the gate-source reference voltage.

The voltage at node 44 is greater than that of node 42 by an amount equal to the base-emitter junction voltage of transistor 34. (Transistor 34 is configured as a diode.) Further, the voltage at the output of the circuit at node 40 is less than the voltage at node 44 by an amount equal to the base-emitter junction voltage of transistor 36. Assuming that NMOS transistors 30 and 32 are matched to one another and assuming that PNP transistors 34 and 36 are also matched, the current flow through the four transistors will be equal. Accordingly, the base-emitter junction voltage of transistors 34 and 36 will be the same, thus the output voltage bias at node 40 will be equal to the gate-source reference voltage of transistor 30 at node 42. This also means that the drain-gate voltage of transistor 32 will be equal to that of transistor 30, namely zero volts.

The output voltage $V_{BIAS}$ is equal to the gate-source voltage as follows:

$$V_{GS} = V_{BIAS} \tag{1}$$

where $V_{GS}$ is the gate-source reference voltage of transistor 30 (node 42); and $V_{BIAS}$ is the output voltage of the bias circuit (node 40).

The gate-source voltage of an MOS transistor is given by the following equation:

$$V_{GS} = V_T + \sqrt{\frac{2 I_B}{W/L\ \beta}} \tag{2}$$

where $V_T$ is the threshold voltage of the transistor;

$I_B$ it the drain source current of the transistor;

$\beta$ is a parameter defined below; and

W/L is the width/length ratio of the transistor channel.

The parameter $\beta$ can be approximated by the following equation:

$$\beta = \frac{\mu C_{ox}}{2} \tag{3}$$

where $\mu$ is the effective surface mobility; and $C_{OX}$ is the transistor gate oxide capacitance.

The threshold voltage $V_T$ term of equation (2) has a negative temperature coefficient and thus will decrease with increasing temperature. Further, mobility $\mu$ of equation (3) has a negative temperature coefficient which cause the $\beta$ parameter to also have a negative temperature coefficient.

The first term of equation (2), $V_T$, will decrease with temperature and the second term will increase with temperature (since $\beta$ is in the denominator). The effects of temperature will, therefore, have a tendency to cancel one another. The magnitude of the second term is preferably selected, by controlling the magnitude of current $I_B$, so that the gate-source voltage $V_{GS}$ and, therefore, the output voltage $V_{BIAS}$ has a temperature coefficient of approximately zero. (The effects of temperature on the base-emitter junction voltage of transistors 34 and 36 will cancel.)

In one embodiment, the values of $V_T$ is approximately 0.9 volts. The width of the channel is 45 microns, and the length is 15 microns to arrive at a W/L ratio of 3. Finally, a temperature coefficient of approximately zero is achieved by adjusting the value of the current source 38 to 20 $\mu$Amps.

It can be seen from the foregoing that NPN transistors 34 and 36, together with NMOS transistor 32 function to couple the gate-source reference voltage from node 42 to the output node 40. In addition, NPN transistor 36, used as an emitter follower, reduces the impedance of the circuit at node 40 to a value substantially less than that at node 42. Accordingly, the output biasing voltage $V_{BIAS}$, is relatively immune to noise.

Thus, a novel biasing circuit particularly suited for use in integrated circuits having bipolar and field effect transistors, such as NMOS transistor, has been disclosed. Although the preferred embodiment of the invention has been described in some detail, it is to be understood that various changes can be made by those skilled in the art without departing from the spirit and scope of the invention as defined by the appended claims. For example, the geometry of transistors 36 and 32 can be adjusted so as to decrease the absolute current flow through these transistors without affecting the magnitude of the various junction voltages. Thus, power consumption of the biasing circuit can be reduced.

I claim:

1. A biasing circuit comprising:

a first field effect transistor having drain, source and gate electrodes;

current source means for supplying a current to the drain electrode of the first field effect transistor so as to produce a gate-source reference voltage at a first node; and means for coupling the gate-source reference voltage to an output to the biasing circuit at substantially the same voltage magnitude as the reference voltage and at a reduced impedance level compared to the first node impedance level, said means for coupling including a first bipolar transistor having an emitter electrode connected to the output.

2. The biasing circuit of claim 1 wherein the means for coupling further includes a forward-biased diode junction disposed between the current source means and the first field effect transistor.

3. The biasing circuit of claim 2 wherein the first bipolar transistor has a base electrode coupled to the forward-biased diode junction.

4. A biasing circuit for providing a bias voltage at the output of the circuit comprising:

first and second MOS transistors, each having gate, drain and source electrodes, with the drain and gate electrodes of the first MOS transistors coupled to the gate electrode of the second MOS transistor and with the source electrodes of the first and second NMOS transistors coupled together;

current source means for providing current to the drain electrode of the first MOS transistor so as to produce a gate-source reference voltage at the first MOS transistor; and means for coupling the reference voltage to the bias circuit output at the same voltage magnitude, said means for coupling including first and second bipolar transistors, each having base, emitter and collector electrodes, with the emitter electrode of the first bipolar transistor coupled to the biasing circuit output and further coupled to the drain electrode of the second MOS transistor and with the base electrode of the first bipolar transistor coupled to the base and collector electrodes of the second bipolar transistor and, further, with the emitter electrode of the second bipolar transistor coupled to the drain electrode of the first MOS transistor.

5. The biasing circuit of claim 4 wherein the source electrodes of the first and second field effect transistors are coupled together.

6. The biasing circuit of claim 5 wherein the first and second field effect transistors are NMOS transistors and the first bipolar transistor is an NPN transistor.

7. The biasing circuit of claim 6 wherein the forward-biased diode junction is the base-emitter junction of a second NPN bipolar transistor.

8. A biasing circuit for providing a bias voltage at the output of the circuit comprising:

first and second MOS transistors, each having gate, drain and source electrodes, with the drain and gate electrodes of the first MOS transistors coupled to the gate electrode of the second MOS transistor and with the source electrodes of the first and second MOS transistors coupled together;

first and second bipolar transistors, each having base, emitter and collector electrodes, with the emitter electrode of the first bipolar transistor coupled to the biasing circuit output and further coupled to the drain electrode of the second MOS transistor and with the base electrode of the first bipolar transistor coupled to the base and collector electrodes of the second bipolar transistor and, further, with the emitter electrode of the second bipolar transistor coupled to the drain electrode of the first MOS transistor; and current source means for providing current to the drain electrode of the first MOS transistor so as to produce a gate-source reference voltage at the first MOS transistor which is coupled to the bias circuit output by the first and second bipolar transistors and the second MOS transistor whereby the voltage magnitude at the biasing circuit output is substantially equal to the magnitude of the gate-source reference voltage.

9. The biasing circuit of claim 8 wherein the first and second MOS transistors are NMOS transistors, and the first and second bipolar transistors are NPN transistors.

10. A method of producing a bias voltage at a relatively low impedance comprising the following steps:

generating a gate-source reference voltage at a first node by conducting a current through the drain-source electrodes of a field effect transistor;

adjusting the magnitude of the current so that the reference voltage has a temperature coefficient of approximately zero; and coupling the gate-source reference voltage to a second node having an impedance which is less than that of the first node, with the coupled voltage having the same magnitude as the reference voltage and with the coupled voltage being the bias voltage.

11. The method of claim 10 wherein the step of coupling includes the following steps:

generating a first diode junction voltage drop;

adding the first diode junction voltage drop to the gate-source reference voltage so as to produce a sum voltage at a third node;

generating a second diode junction voltage drop;

subtracting the second diode junction voltage drop from the sum voltage at the third node so as to produce the bias voltage at the second node.

12. The method of claim 11 wherein the step of coupling includes the following additional steps:

generating a gate-drain transistor voltage in a second field effect transistor utilizing the gate-source reference voltage; and adding the gate-drain voltage to the gate-source reference voltage so as to produce the bias voltage at the second node.

13. The method of claim 12 wherein the step of generating a gate-drain voltage in the second field effect transistor includes the step of generating a gate-drain voltage in the first field effect transistor of approximately zero volts.

* * * * *